United States Patent [19]

Towle

[11] Patent Number: 4,746,927

[45] Date of Patent: May 24, 1988

[54] VOR ANTENNA DESIGN

[75] Inventor: Allistair Towle, Willowdale, Canada

[73] Assignee: U.S. Philips Corporation, New York, N.Y.

[21] Appl. No.: 794,206

[22] Filed: Nov. 1, 1985

[30] Foreign Application Priority Data

Nov. 8, 1984 [CA] Canada ..... 467390

[51] Int. Cl.[4] ..... H01Q 7/04

[52] U.S. Cl. ..... 343/842; 343/743

[58] Field of Search ..... 343/743, 742, 732, 741, 343/842

[56] References Cited

U.S. PATENT DOCUMENTS

| | | | |
|---|---|---|---|
| 2,465,379 | 3/1949 | Kandoian | 343/743 X |
| 2,490,815 | 12/1949 | Kandoian | 343/743 |
| 2,539,433 | 1/1951 | Kandoian | 343/742 |
| 2,615,134 | 10/1952 | Carter | 343/742 |
| 2,639,382 | 5/1953 | Jarvis | 343/743 X |
| 2,642,529 | 6/1953 | Frankel | 343/741 X |
| 3,427,622 | 2/1969 | Kandoian et al. | 343/742 |
| 3,613,099 | 10/1971 | Hollins | 343/742 |

FOREIGN PATENT DOCUMENTS

| | | | |
|---|---|---|---|
| 0012645 | 6/1980 | European Pat. Off. | 343/742 |

*Primary Examiner*—Gene Wan
*Assistant Examiner*—Seung Ham
*Attorney, Agent, or Firm*—Thomas A. Briody; Algy Tamoshunas; William J. Streeter

[57] ABSTRACT

A VOR antenna array with a plurality of radiating antenna elements spaced around and arranged on the periphery of an essentially circular path. The elements extend in the same direction around the periphery of the circular path and a central feed point is connected to the equivalent end of each radiating element by a feed-line to form a multi-sectored loop fed at the junction of each sector by in-phase sources.

3 Claims, 1 Drawing Sheet

VOR ANTENNA DESIGN

The invention is directed to a VOR antenna array with a plurality of radiating antenna elements equally spaced and circularly arranged around a central feed point to form an omni-directional antenna system.

U.S. Pat. No. 2,283,897, issued May 26, 1942, and U.S. Pat. No. 2,327,485, issued Aug. 24, 1943 by Andrew Alford, show several types of loop antenna configuration for VOR systems.

U.S. Pat. No. 3,611,389—Coors et al—issued Oct. 5, 1971 describes another type of VOR antenna formed by printed circuits with eigth arcuate sections surrounding four printed circuit half-dipoles disposed in a cross-configuration. The arcuate sections are fed in balance from a central feed point forming a turnstile antenna with a loop antenna symmetrically arranged around the turnstile antenna.

Canadian Pat. No. 804,747—Melancon—issued Jan. 21, 1969 shows another type of antenna formed by printed circuit techniques with three dipoles and three excitation means printed upon a circular plastic disc. Each excitation means consists of parallel wire transmission lines having wires printed on either side of the disc with these wires being connected to the dipoles. These dipoles each consist of two halves with a first section of each dipole half being printed on one side of the disc and extending along its periphery while the other section of the dipole is printed upon the other side of the disc and extends along its periphery in the opposite direction to the first section.

However, all the antennas shown in the above-mentioned references by Coors et al and Melancon would have large electrical potentials at the edges of the antennas close to the edges of adjacent antennas which would result in displacement currents flow between antennas and as a consequence, undesired radiation could be emitted from support structures or feed lines. U.S. Pat. No. 3,613,099—Hollins—issued Oct. 12, 1971 shows other types of VOR antenna formed by a four dipole array with coaxial feeder lines connected across balun gaps located at midpoints of the four radiating tubular elements of the array. The co-axial feeder lines are located in hollow tubular support arms which extend from the centre of the array to ends of the radiating elements. Each feeder line then extends inside one of the tubular radiating elements to a balun gap where an impedance compensation network is situated and used for connecting this feeder line to an associated radiating element. No net current flows in the support arms and these members are unexcited and do not contribute to or distort the radiation pattern.

SUMMARY OF THE INVENTION

It is an object of the present invention to avoid problems with existing designs and to provide a simpler antenna design with coaxial feeder lines and radiating elements, which elements require no central balun gap with impedance compensation networks.

A further object of the present invention is to provide an antenna design which is easily fabricated.

Ideally the antenna should be a round loop with uniform, in phase, current distribution, and having sufficient dimensions to achieve reasonable radiation resistance, thus not requiring high-Q narrow band matching networks which suggests a feed system introducing in-phase currents at a plurality of points on the circumference. The lack of strong electric fields allows for possible overlap of antennas thus increasing size and radiation resistance.

One embodiment of the present invention consists of a VOR antenna system with a plurality of radiating antenna elements spaced and arranged on the periphery of a circle, the elements extending in the same direction around the periphery of the circle and having a central feed point connected to each radiating element by a feed-line.

A further embodiment consists of a VOR antenna wherein a central co-axial feed point is connected to co-axial cables which form the feed-lines to the radiating elements, the outer ends of the co-axial cables constituting the radiating elements.

A still further embodiment consists of a VOR antenna wherein the radiating elements and the feed-lines are formed using stripline techniques.

Other objects, features and embodiments of the invention will become more readily apparent from the following description of preferred embodiments with reference to the accompanying drawings.

DESCRIPTION OF THE PREFERRED EMBODIMENT

Figure 1:
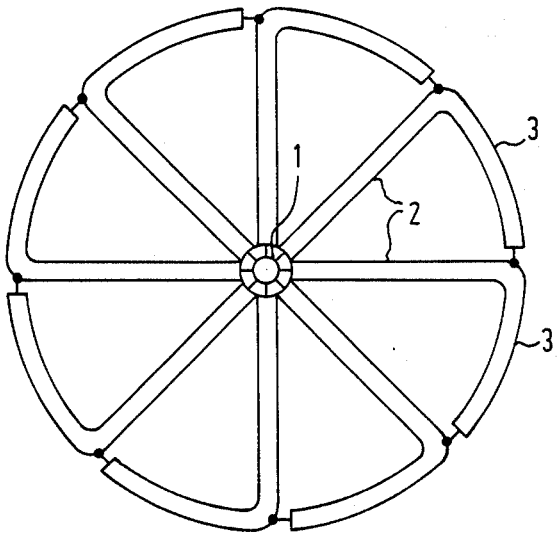
FIG. 1 is a diagram of an antenna system according to one embodiment of the present invention.

In the antenna system illustrated in FIG. 1, reference numeral 1 indicates a central co-axial feed point which is connected to a plurality of co-axial cables forming feed-lines 2 to the radiating elements 3. The outer conductors of the ends of the co-axial cables constitute the radiating elements 3.

For impedance matching, suitable impedance and length of the feed-radiating co-axial cables 2/3 may be chosen and one or more stubs of co-axial cable, or equivalent, may be attached to the co-axial connection 1.

The electrical potentials at the periphery of the antenna system shown in FIG. 1 will be very low and by the addition of a second array immediately above or below this array, inverted and fed out of phase with respect to the first array, the effective edge potential can be made negligible. Three layer designs which are especially simple using stripline (printed circuit) techniques would be extremely effective as their top and bottom planes could be neutral electrically.

Figure 2:
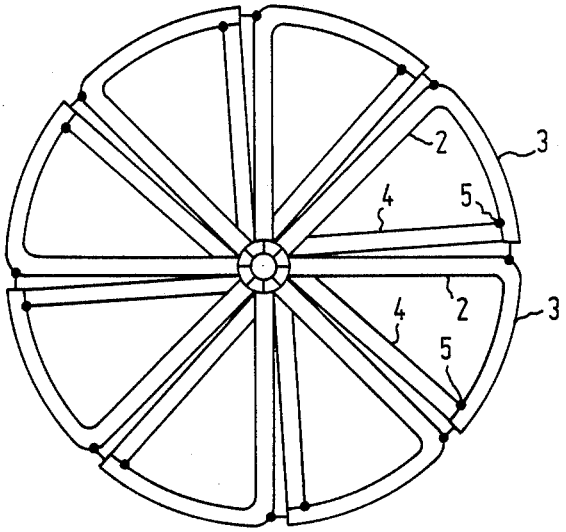
FIG. 2 shows a furtner embodiment of the antenna system illustrated in FIG. 1.

FIG. 2 shows a further embodiment, designed to prevent a small amount radiation from the co-axial feed cables 2. In this embodiment the feed cables 2 are connected in parallel with similar cables 4 whose outer extremities are connected at 5 to the outer conductor of adjacent co-axial cable radiating elements 3 at their terminations.

The antenna system according to the embodiments previously described consists of a multi-sectored loop fed at the junction of each sector by in-phase sources and as a result of the circular symmetry, the radiation pattern will be essentially circular. However, in certain special cases such as doppler sideband arrays, a controlled non-circularity may be desirable which may readily be achieved by making the loop elliptical, or by grading the lengths of the radiating elements.

It will be apparent to those skilled in the art that various additions, substitutions and modifications can be made to the described embodiments without departing from the spirit and scope of the invention as defined in the following claims.

What is claimed is:

1. A VOR antenna array comprising a first plurality of radiating elements lying along a common circumference, each radiating element comprising a coaxial feedline having a center conductor and an outer conductor, extending from an open end along an arc of said circumference in a first direction and thence extending at a bend point radially inward to a common feed point, said open end of each radiating element having a center conductor connected to the outer conductor of an adjacent radiating element at a bend point to form a closed array of said radiating elements.

2. The VOR antenna of claim 1 further comprising a second array located below the first array, the second array being inverted and fed out of phase with respect to the first array.

3. The VOR antenna according to claim 1 further comprising a second coaxial feedline in parallel with each of said radiating element coaxial feedlines, said second coaxial feedline having an outer conductor connected to an adjacent radiating element outer conductor.

* * * * *